US005270905A

United States Patent [19]

Trevino

[11] Patent Number: 5,270,905

[45] Date of Patent: Dec. 14, 1993

[54] CEILING FAN GLOBE GASKET

[76] Inventor: Feliberto Trevino, Rte. 1, Box 280, No. 46, San Juan, Tex. 78789

[21] Appl. No.: 905,879

[22] Filed: Jun. 29, 1992

[51] Int. Cl.[5] ..... F21V 33/00

[52] U.S. Cl. ..... 362/96; 362/267; 416/5; 277/DIG. 10; 277/235 A

[58] Field of Search ..... 362/96, 149, 267, 294, 362/310, 363, 389, 453; 416/5; 277/227, 235 A, DIG. 10

[56] References Cited

U.S. PATENT DOCUMENTS

| | | | |
|---|---|---|---|
| 694,435 | 3/1902 | Smart | 362/363 |
| 1,184,747 | 5/1916 | Herskovitz | 362/453 |
| 2,119,398 | 5/1938 | Morse | 416/5 |
| 2,201,153 | 5/1940 | Brown | 362/96 |
| 2,809,060 | 10/1957 | Thompson | 277/DIG. 10 |
| 4,426,677 | 1/1984 | Dennis | 362/453 |
| 4,428,032 | 1/1984 | Workman | 362/96 |
| 4,531,179 | 7/1985 | Baker | 362/453 |

*Primary Examiner*—Albert J. Makay
*Assistant Examiner*—Y. Quach
*Attorney, Agent, or Firm*—Leon Gilden

[57] ABSTRACT

A ceiling fan having an illumination globe mounting flange and an illumination globe includes a cylindrical gasket positioned between the mounting flange and the globe flange to maintain vibration free securement of the globe relative to the ceiling fan structure.

2 Claims, 4 Drawing Sheets

CEILING FAN GLOBE GASKET

BACKGROUND OF THE INVENTION

1. Field of the Invention

The field of invention relates to ceiling fan apparatus, and more particularly pertains to a new and improved ceiling fan globe gasket in operative communication between a ceiling fan and associated globe to maintain vibration free association between the globe and the ceiling fan.

2. Description of the Prior Art

In the mounting of ceiling fans and associated illumination structure, the illumination globe associated with such structure is positioned relative to the ceiling fan utilizing threaded fasteners directed radially through a cylindrical mounting flange of the ceiling fan. During continued use and vibration of the ceiling fan, the fasteners tend to withdraw relative to the globe to permit the globe to loosen and ultimately separate relative to the ceiling fan. To overcome deficiencies of the prior art, the instant invention utilizes a resilient cylindrical gasket mounted between the ceiling fan and the globe to maintain a vibration free association therewith.

Various gasket structure has been utilized in the prior art and exemplified by the U.S. Pat. Nos. 4,423,109; 4,580,794; 4,956,226; and 4,170,365.

The gasket structure of the prior art has heretofore failed to recognize the operative association between a ceiling fan and illumination globe to maintain a vibration free association therebetween and in this respect, the present invention substantially fulfills this need.

SUMMARY OF THE INVENTION

In view of the foregoing disadvantages inherent in the known types of gasket structure now present in the prior art, the present invention provides a ceiling fan globe gasket wherein the same is mounted between a ceiling flange and associated globe. As such, the general purpose of the present invention, which will be described subsequently in greater detail, is to provide a new and improved ceiling fan globe gasket which has all the advantages of the prior art gasket structure and none of the disadvantages.

To attain this, the present invention provides a ceiling fan having an illumination globe mounting flange and an illumination globe includes a cylindrical gasket positioned between the mounting flange and the globe flange to maintain vibration free securement of the globe relative to the ceiling fan structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ceiling fan globe gasket which has all the advantages of the prior art gasket structure and none of the disadvantages.

It is another object of the present invention to provide a new and improved ceiling fan globe gasket which may be easily and efficiently manufactured and marketed.

It is a further object of the present invention to provide a new and improved ceiling fan globe gasket which is of a durable and reliable construction.

An even further object of the present invention is to provide a new and improved ceiling fan globe gasket which is susceptible of a low cost of manufacture with regard to both materials and labor, and which accordingly is then susceptible of low prices of sale to the consuming public, thereby making such ceiling fan globe gaskets economically available to the buying public.

Still yet another object of the present invention is to provide a new and improved ceiling fan globe gasket which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
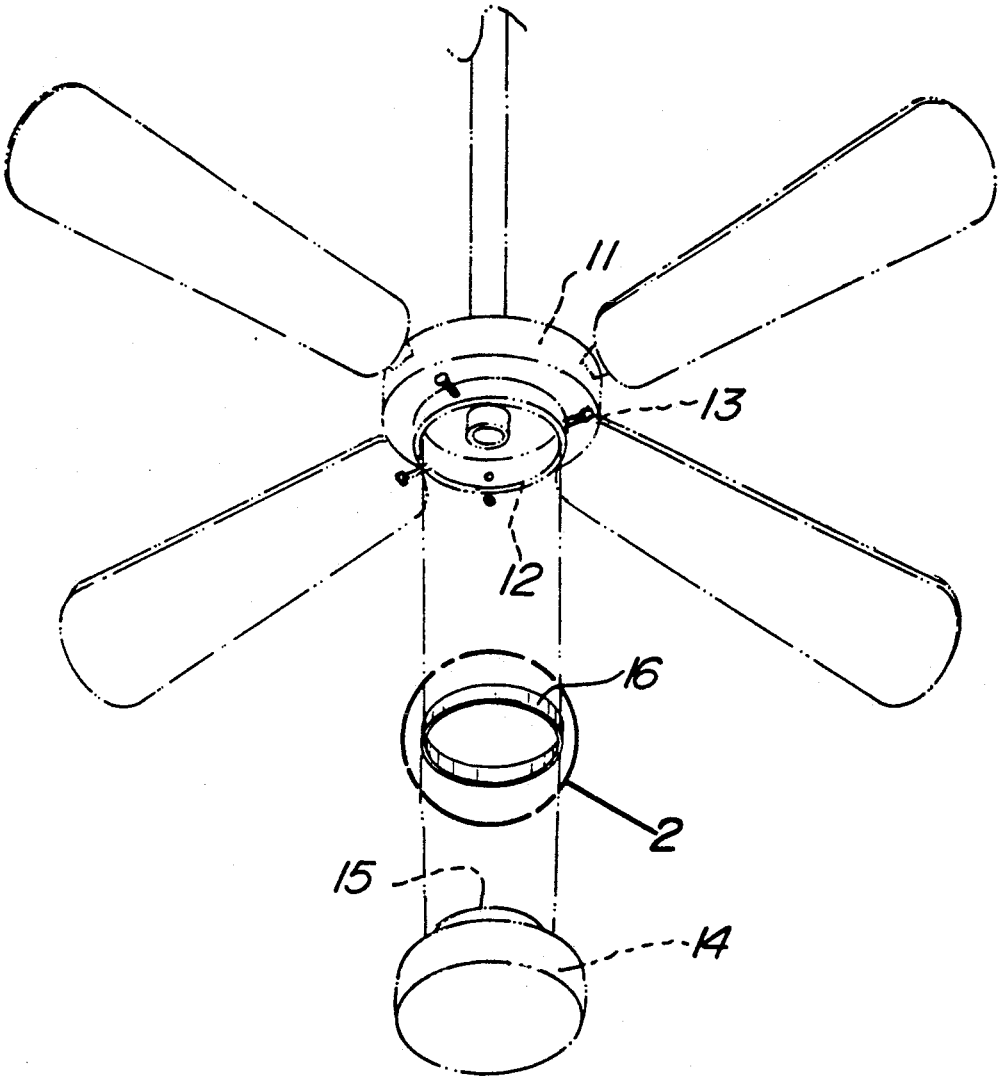
FIG. 1 is an isometric illustration of the instant invention.
Figure 2:
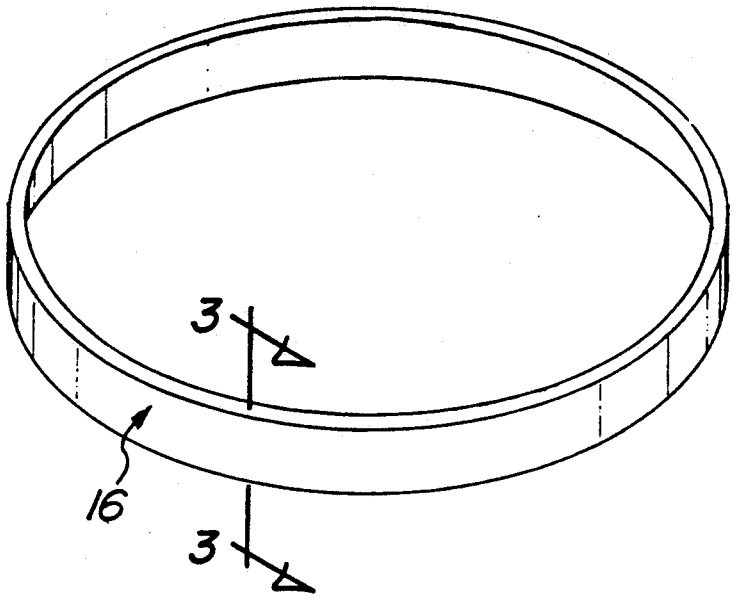
FIG. 2 is an enlarged isometric illustration of section 2 as set forth in FIG. 1.
Figure 3:
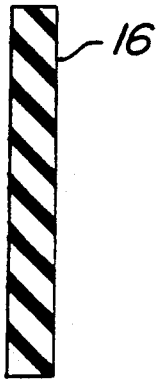
FIG. 3 is an orthographic view, taken along the lines 3—3 of FIG. 2 in the direction indicated by the arrows.
Figure 4:
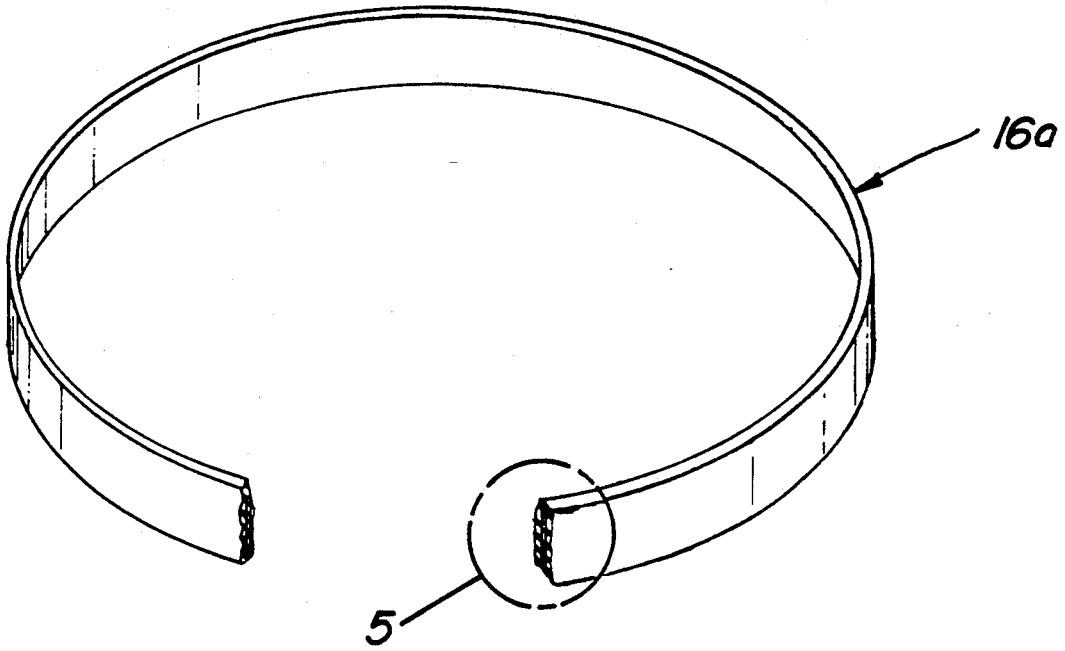
FIG. 4 is an isometric illustration of a modified gasket structure of the invention.
Figure 5:
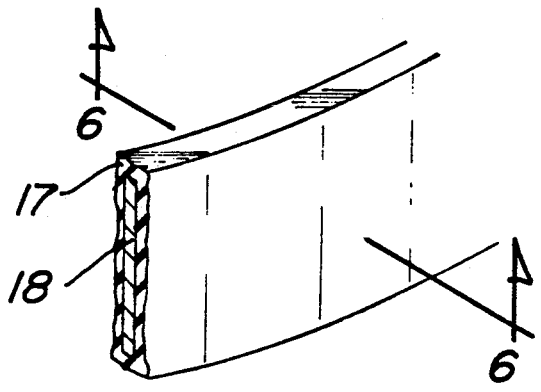
FIG. 5 is an enlarged isometric illustration of section 5 as set forth in FIG. 4.
Figure 6:
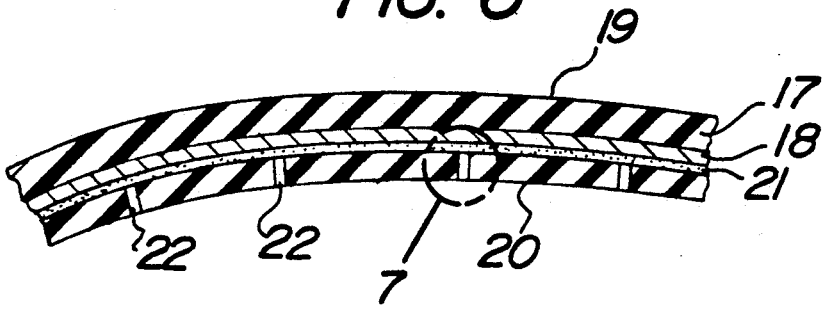
FIG. 6 is an orthographic view, taken along the lines 6—6 of FIG. 5 in the direction indicated by the arrows.
Figure 8:
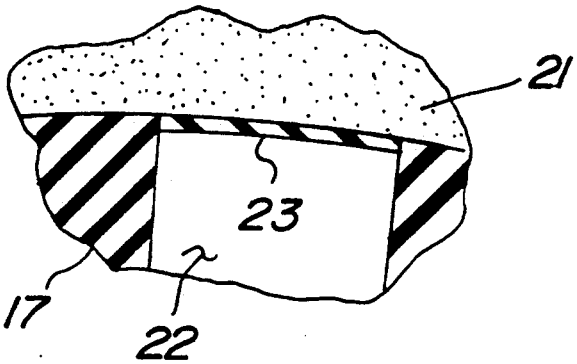
FIG. 8 is an enlarged orthographic view of section 8 as set forth in FIG. 7.
Figure 7:
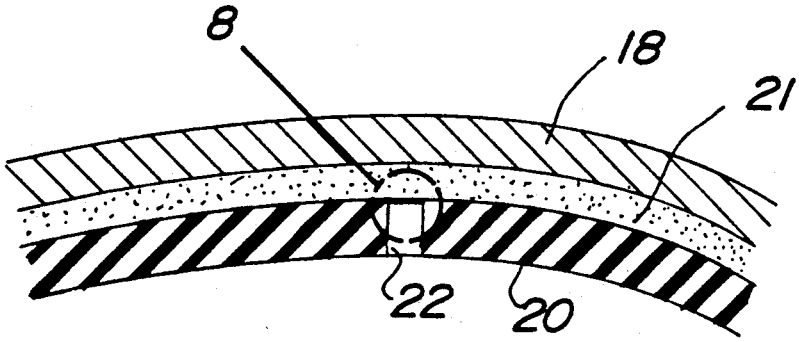
FIG. 7 is an enlarged orthographic view of section 7 as set forth in FIG. 6.

With reference now to the drawings, and in particular to FIGS. 1 to 8 thereof, a new and improved ceiling fan globe gasket embodying the principles and concepts of the present invention and generally designated by the reference numerals will be described.

More specifically, the ceiling fan globe gasket of the instant invention essentially comprises the use of a ceiling fan 11 having a ceiling fan cylindrical support flange 12 positioned coaxially of the ceiling fan extending downwardly therefrom. A plurality of externally threaded fastening screws 13 are radially directed into the support flange 12 to secure and cooperate with a lighting globe member 14 having a globe member cylindrical flange 15 received within the cylindrical support flange 12 in a coaxially aligned relationship. A cylindrical gasket assembly 16 is provided having a predetermined internal diameter substantially equal to the globe member cylindrical flange outer diameter for receiving fastening screws 13 in a vibration free relationship between the globe and the fan construction to prevent withdrawal of the screws 13 during use of the fan structure.

The FIGS. 4–8 illustrate a modified gasket assembly having an outer resilient polymeric sheath 17 encasing a central metallic stiffener cylindrical band 18. The gasket assembly 16*a* further is defined by a band cylindrical outer wall 19 coaxially aligned with a concentric band cylindrical inner wall 20. A cylindrical fluid adhesive band 21 is contained between the metallic stiffener cylindrical band 18 and the band cylindrical inner wall 20, with a plurality of fluid delivery ports 22 projecting through the cylindrical inner wall 20 to the adhesive band 21. A sealing membrane 23 is positioned within each delivery port 22 in a sealing relationship in adjacency to the adhesive band 21 in a substantially contiguous relationship. Rupturing of the membranes 23 are effected upon flexure of the sheath 17 by directing the fastening screws 13 into the modified gasket assembly 16*a* to permit flow of adhesive from within the adhesive band 21 through the ports 22 into communication with the globe member cylindrical flange 15 to secure and adhere the gasket assembly 16*a* to the globe member cylindrical flange 15 avoiding reassembly between the gasket assembly 16*a* and the globe member cylindrical flange 15.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact contruction and operation shown and described, and accordingly, all suitable modifications and equivalent may be resorted to, falling within the scope of the invention.

What is claimed as being new and desired to be protected by Letters Patent of the United States is as follows:

1. A ceiling fan globe gasket, comprising, a ceiling fan having a cylindrical support flange, the cylindrical support flange including a plurality of externally threaded fastening screws threadedly directed through the cylindrical support flange, and a lighting globe member, the lighting globe member received within the cylindrical support flange in a coaxially aligned relationship, with the lighting globe member including a globe member cylindrical flange receiving the plurality of externally threaded fastening screws, and a resilient cylindrical gasket member received in surrounding relationship relative to the globe member cylindrical flange, and the resilient cylindrical gasket member includes an outer polymeric resilient sheath, and a central metallic stiffening cylindrical band contained within the sheath, and the resilient cylindrical gasket member having a cylindrical outer wall concentric with a cylindrical inner wall, and a cylindrical fluid adhesive band contained within the resilient cylindrical gasket member between the cylindrical inner wall and the central metallic stiffening cylindrical band, and a plurality of fluid delivery ports extending into the cylindrical inner wall into communication with the cylindrical fluid adhesive band.

2. A ceiling fan globe gasket as set forth in claim 1 including a sealing membrane contained within each of said plurality of fluid delivery ports, with said sealing membrane in contiguous communication at an interface between each of said plurality of fluid delivery ports and the cylindrical fluid adhesive band, wherein flexure of the resilient cylindrical gasket member effects rupture of the sealing membrane and by directing the threaded fastening screws through the resilient cylindrical gasket member permits of adhesive within the cylindrical fluid adhesive band to flow through the plurality of fluid delivery ports into communication with the globe member cylindrical flange.

* * * * *